US009290355B2

(12) United States Patent
Worton

(10) Patent No.: US 9,290,355 B2
(45) Date of Patent: Mar. 22, 2016

(54) BULK ELECTRICAL TRAILER AND METHOD OF USE

(71) Applicant: Ken Worton, Midvale, UT (US)

(72) Inventor: Ken Worton, Midvale, UT (US)

( * ) Notice: Subject to any disclaimer, the term of this patent is extended or adjusted under 35 U.S.C. 154(b) by 304 days.

(21) Appl. No.: 13/923,207

(22) Filed: Jun. 20, 2013

(65) Prior Publication Data

US 2013/0341455 A1 Dec. 26, 2013

Related U.S. Application Data

(60) Provisional application No. 61/664,153, filed on Jun. 26, 2012.

(51) Int. Cl.
*B65H 49/32* (2006.01)
*B65H 49/38* (2006.01)

(52) U.S. Cl.
CPC ..... *B65H 49/32* (2013.01); *B65H 49/38* (2013.01); *B65H 2402/42* (2013.01)

(58) Field of Classification Search
CPC ..... B65H 49/32; B65H 49/325; B65H 49/34; B65H 2402/42; B65H 54/58; B65H 54/74; B65H 75/20; B65H 75/425; B65H 75/4402; B65H 75/22; H02G 1/08
See application file for complete search history.

(56) References Cited

U.S. PATENT DOCUMENTS

| | | | | |
|---|---|---|---|---|
| 3,520,489 | A * | 7/1970 | Flowers | 242/388.8 |
| 3,739,985 | A * | 6/1973 | Odom et al. | 242/390.7 |
| 6,435,450 | B1 * | 8/2002 | Shields et al. | 242/594.3 |
| 6,932,294 | B1 * | 8/2005 | Larson | 242/390.5 |

* cited by examiner

*Primary Examiner* — Monica Carter
*Assistant Examiner* — Seahee Yoon
(74) *Attorney, Agent, or Firm* — J. Todd Rushton

(57) ABSTRACT

A bulk electrical wire trailer having removable wire spool racks that include an isolated or independently rotating ground wire spool. The wire rack spools are removable from the trailer and the spools may be rotated and locked into any position facing the project. The bulk electrical wire trailer being used as method to readily distribute bulk wire to a job site or may be used as an incentive to attract electrical contractors to a distributor.

17 Claims, 7 Drawing Sheets

BULK ELECTRICAL TRAILER AND METHOD OF USE

This application claims priority to provisional application U.S. 61/664,153, filed Jun. 26, 2012. The disclosure therein incorporated by reference.

BACKGROUND

Commercial electrical projects can require thousands of feet of solid insulated electrical wire and a bare ground wire. The wire is typically purchased bulk on wooden or stamped metal spools that are transported to the job site, where the spools are placed on an improvised axle and jack stands. The spools must be level to keep the wire unwinding evenly when pulled and to keep the wooden spool centered on the jack stands. The wire maybe pulled through a series of secondary guides or guide stands to get the wire to the conduit being pulled. When the wire is pulled at an angle from a wooden spool the wire will have a tendency to snag or catch in on the rim of the spool. Once setup, this type of arrangement must be completely disassembled prior to moving the wire spool to a new location.

Wire distributors and electrical wholesalers have addressed some of these shortcomings with wire distribution by providing fabricated wire spools attached to a towable trailer. Typically there are five spools on a stand which rotate on a single axle, this allows the electrical contractor to pull four insulated conductor wires and a bare ground wire from the spools at the same time. Some issues with this system include getting the loaded trailer close to, and aligned with, the conduit being pulled or the need to provide guide stands when pulling the wire from the trailer to conduit with an indirect route from the parked trailer. Additionally there is presently an issue where the insulated conductor wires have a larger diameter and feed off the spool at a slower rate than the un-insulated ground wire. On long wire pulls this causes the ground wire to go slack and pile up on the ground in front of the distribution trailer. What is needed is a bulk wire distribution trailer that allows the wire spools to be easily moved to the work site, aligned with the specific conduit being pulled, and remedies the issue of the ground conductor wire going slack.

SUMMARY OF THE INVENTION

The present invention is a bulk electrical wire trailer having rotationally aligning, removable wire spool racks that include an isolated or independently rotating ground wire spool and methods for using the bulk electrical wire trailer for wire sales and distribution.

One embodiment of the present invention or bulk electrical wire trailer has one or more removable wire spool racks that fit into a track system on the trailer. In one embodiment, the trailer is designed to accommodate one wire spool rack, in yet another embodiment the trailer is designed to accommodate two wire spool racks, and in yet another embodiment, the trailer is designed to accommodate three or more wire spool racks. The wire spool rack base includes a series of guide wheels that engage the inside portion of a c-channel or similar structure attached to the deck or side rails of the trailer. Guide wheels drop into the channel at an opening at the rear of the trailer, once engaged the wire spool rack can be moved into a forward position, allowing for a locking tailgate to be moved into place, or one or more additional wire spool racks can be place in the trail guide rails prior to closing the locking tailgate assembly.

In one embodiment of the present invention, or bulk electrical trailer, the wire spool racks include four or more gang wire spools that rotate on a common axle bearing assembly, the gang wire spools are used to distribute insulated wire strands of equal size. An independently rotating single spool for bare ground wire is assembled on a common axle with the gang spools. However, the single spool has an independent bearing assembly allowing the bare wire to be distributed off the single axle at different a rate. In another embodiment of the present invention, the single ground wire spool may be on a different axle assembly. In yet another embodiment of the present invention, the single ground wither spool may be locked into the common axle with the gang wire spools.

In one embodiment of the present invention or bulk electrical wire trailer, the wire spool assembly includes an adjustable friction brake assembly or lock-out. The friction brake assembly can be used to control tension on the wire being pulled, allowing for better wire control by the electrician. Slight amounts of friction can be used to keep the spools from "free-wheeling" and dumping wire on the ground when the wire is being pulled at high rate of speed. The friction brake assembly may also be used to completely lock the wire spools during transport. In one embodiment the friction brake is a disc brake, and in yet another embodiment the friction brake is a drum brake. In each embodiment the friction brake assembly is concentrically attached to the spool spindle shaft. In one embodiment the ground conductor spool includes a separate friction brake assembly.

In one embodiment of the present invention, the wire spool racks are mounted on a pivoting frame, having a cross-member and uprights where the wire spool rack is secured under a reciprocal set of pillow-block bearings. The frame pivots on a caster plate assembly designed to support the weight of fully loaded wire spools. The assembly including a pivot brake assembly that can engage the base plate of the wire rack assembly at any point around a 360 degree rotation. In one embodiment the pivot brake assembly is a hand driven gear assembly that lowers a friction plate against the base plate of the wire rack assembly. In yet another embodiment the pivot brake assembly is actuated by a pneumatic or hydraulic ram. In another embodiment the pivot brake is a simple cam lock or lever-over linkage assembly. The caster plate assembly and pivot brake assembly allows the wire spools to be aligned directly toward the conduit being pulled, and then locked into place, allowing direct alignment of the wire being pulled without repositioning the wire trailer or the wire spool racks.

In one embodiment of the present invention or bulk electrical wire trailer, the wire spools can be loaded from bulk warehouse spools by starting the individual wire strands and then engaging a traditional pneumatic or electric drive that turns the wire spools during reloading. In one embodiment, the drive is attached directly to the end of the wire spool rack axle, in yet another embodiment, the drive is attached at a gearbox that turns the wire spools at an increased or decrease rate of speed. In one embodiment, drive connection is formed in the end of the common axle. The drive connection maybe one of a square or hex socket or may be a square or hex nut formed on a free end of the common axle. In one embodiment of the present invention or bulk electrical wire trailer, the wire spool racks are configured to be handled by a conventional fork lift, with the wire spool racks having tine slots cut into the platform base plate. In some situations it may be necessary to handle the wire spool racks using a crane with a sling assembly.

It contemplated that the bulk electrical wire trailer assembly is used in conjunction with an electrical contractor who will own his own trailer which is taken to the distributor to be loaded with wire prior to a project. The trailer assembly may also be used in conjunction with a wire distribution or electrical wholesaler where the trailer is used as a convenience or incentive for contractors to buy wire. The trailer has the ability to be loaded with wire at the distributor and picked up by the contractor or may be deliver to the job site.

Once at the job site, the wire can be installed directly off the trailer by parking the trailer in a position proximate the work, aligning the wire racks towards the current pull and pulling the proper amount of wire off of the bulk spools. The contractor may also choose to unload the individual wire racks and move them in position on the job site using a fork lift. The individual wire racks can be moved into places where the loaded trailer cannot go. Once the individual wire racks are placed on the ground, they can be rotated to face the work and locked in place; the spool friction can be adjusted and the wire can be pulled from the spool. The wire rack stand can be relocated for a different pull or the spool assembly may simply be rotated toward a new pull. It is contemplated that bulk electrical wire trailer can be used to deliver spool racks to a job site and then returned directly to the distributor to pick up an new delivery. Once empty, the spool racks be picked up by the trailer and returned to the electrical distributor.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAIL DESCRITION OF THE DRAWINGS

Figure 1:
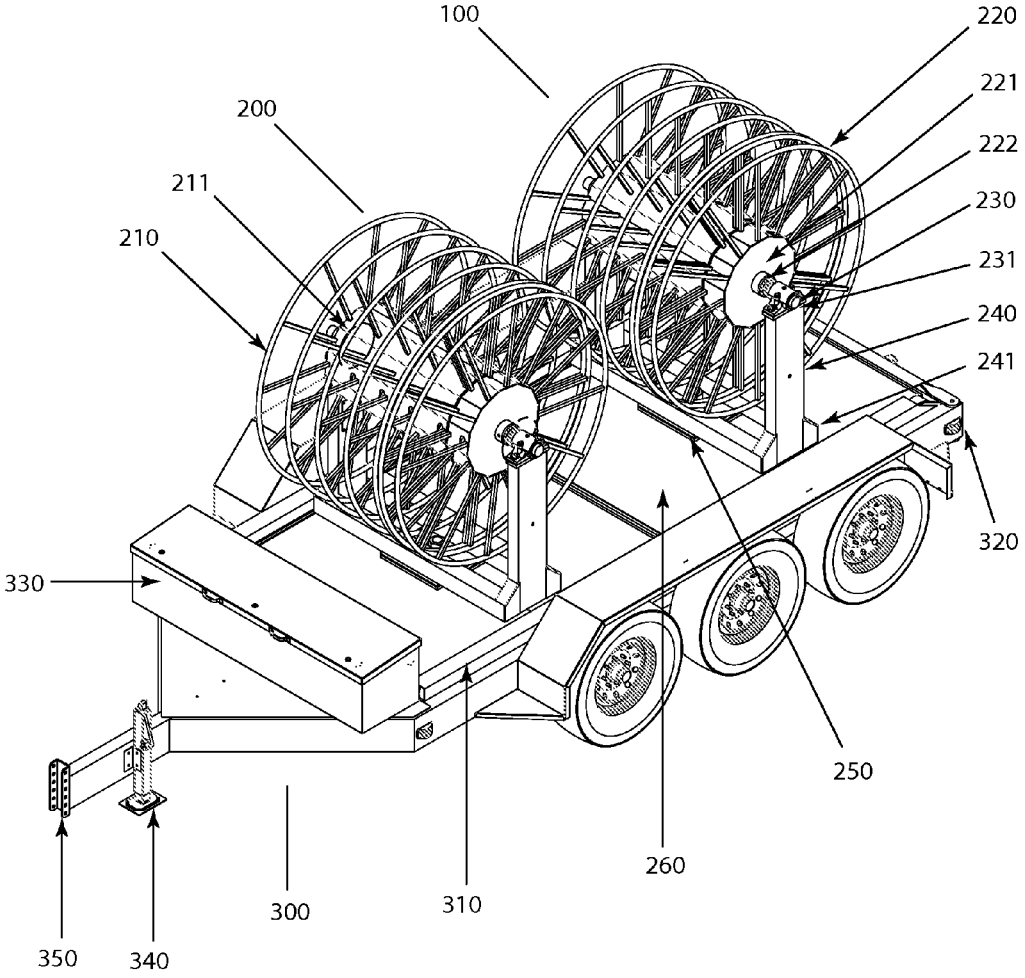
FIG. 1, is orthogonal view of a bulk electrical wire trailer of the present invention.
Figure 2:
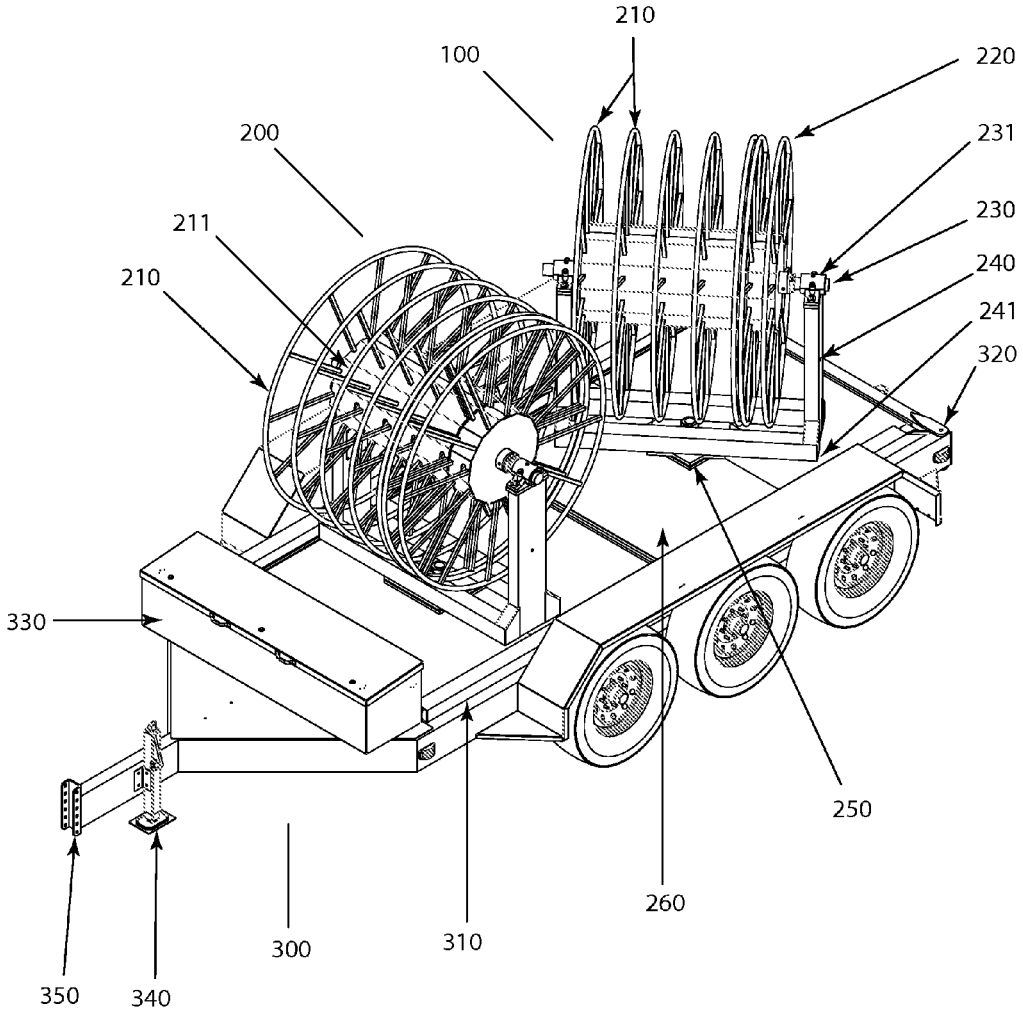
FIG. 2, is orthogonal view of a bulk electrical wire trailer of the present invention.
Figure 3:
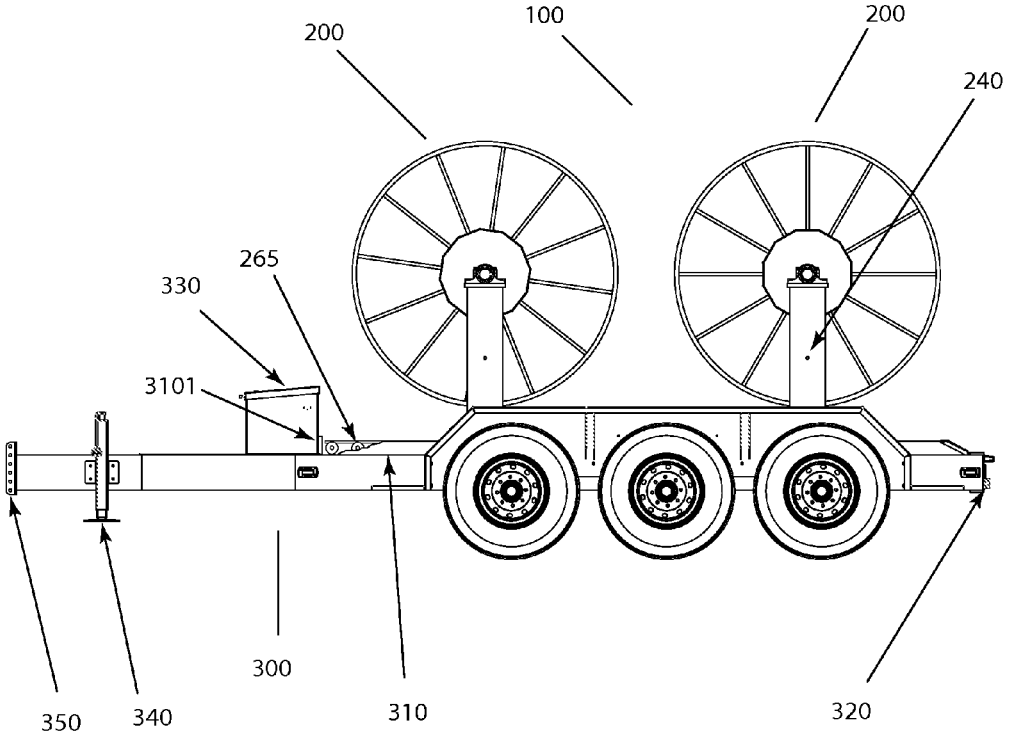
FIG. 3, is a side view of a bulk electrical wire trailer of the present invention.
Figure 4:
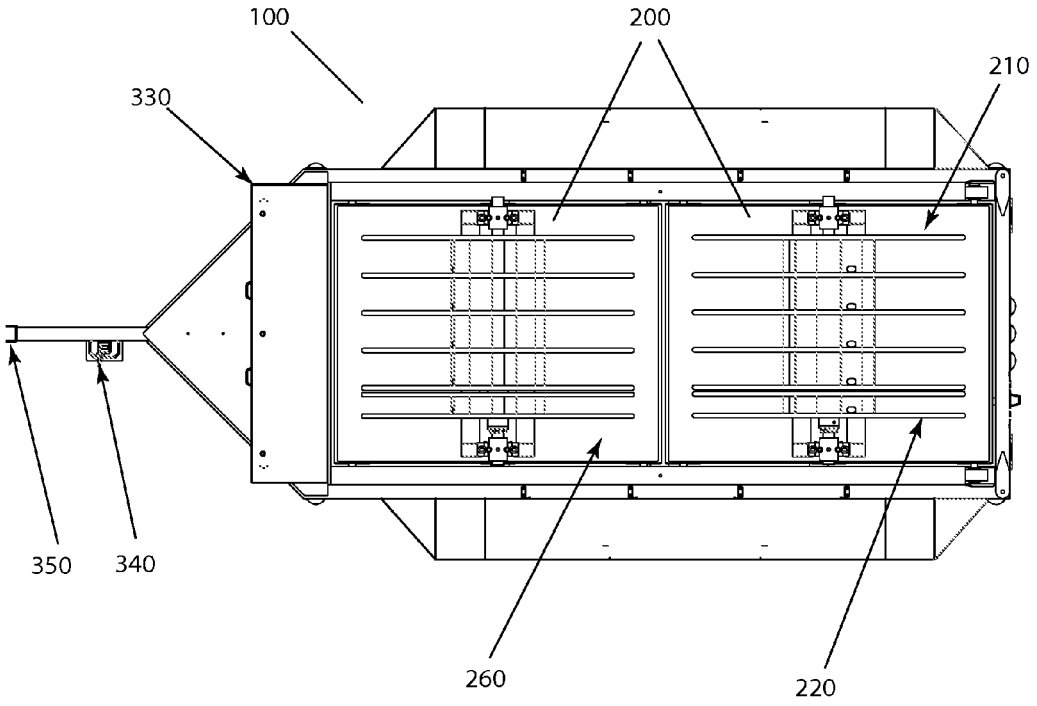
FIG. 4, is a top view of a bulk electrical wire trailer of the present invention.
Figure 5:
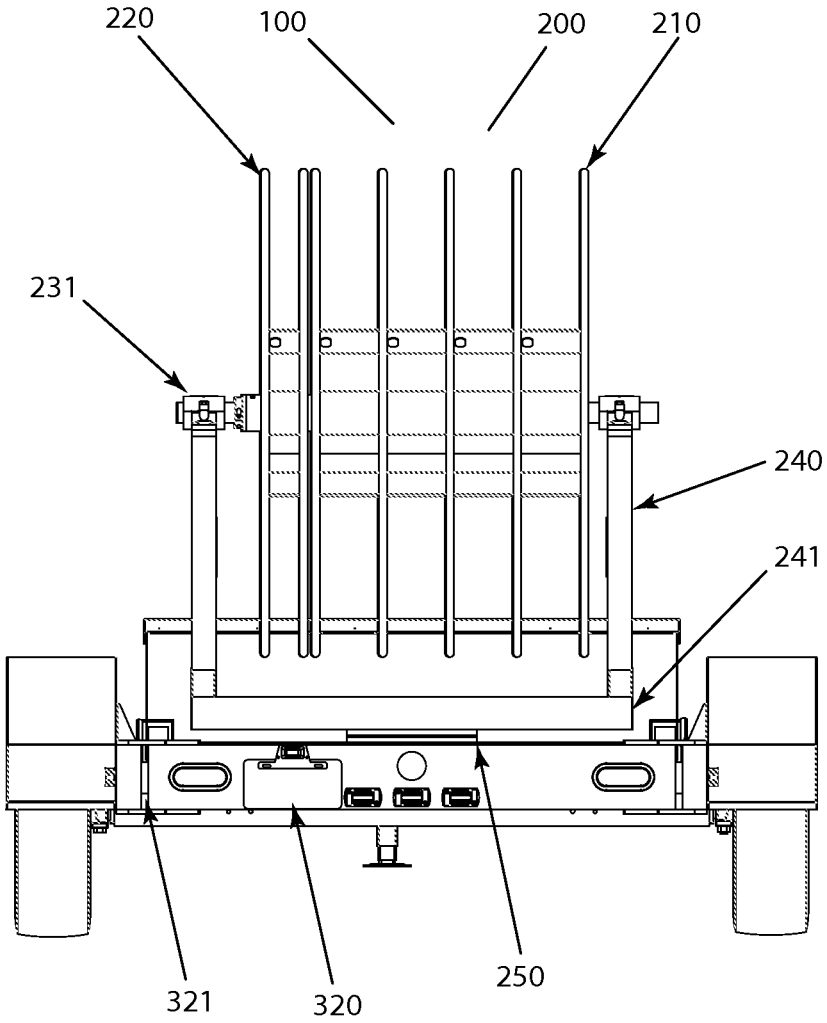
FIG. 5, is a back view of a bulk electrical wire trailer of the present invention.

FIGS. 1 through 5 are one embodiment of the present invention, or a bulk electrical wire trailer 100. The wire trailer 100 having a trailer portion 300 including, towing hitch adaptor 350, leveling jack 340, utility box 330, wire rack wheel rails 310, having a stop block assembly 3101 at the first end the rails 310 toward the tongue of the trailer, configured to restrain the wire racks 200 from moving forward beyond the first end of the rails 310 and a tail gate assembly 320 at the second end of the rails 310 proximate the rear of the trailer 300. Trailer 300 having additional features typical to general utility trailers including side rails, tongue, tire, fenders etc. The rack wheel rails 310 configured as a c-channel sized to securely accommodate a plurality of rollers 265 attached to the wire rack base 260. The tailgate assembly 320 is used to secure the wire racks in place and includes a hinge portion 321 and closure mechanism (not shown). The wire rack assembly 200 may be used to store, and precisely distribute bulk electrical wire and includes gang spools 210 that rotate on a common axle 230, the gang spools have a central hub portion 211. A single, independently rotating, ground wire spool 220 is installed on the same axle 230 as the gang spools 210 but has its own internal bearing set 222 (not visible) and hub portion 221. The spools are supported on a stand assembly having two uprights 240 and cross member 241, the support stand rotates on a caster plate assembly 250. The spool axle 230 rotates inside of pillow block bearing 231. The entire wire rack assembly 200 can be removed from trailer 300 and set down on base plate 260. FIG. 2 is one embodiment of the bulk electrical wire trailer 100 with one wire rack assembly 200 partially rotated to precisely align the gang spools 210 and the ground wire spool 220 toward the conduit being pulled.

Figure 7:
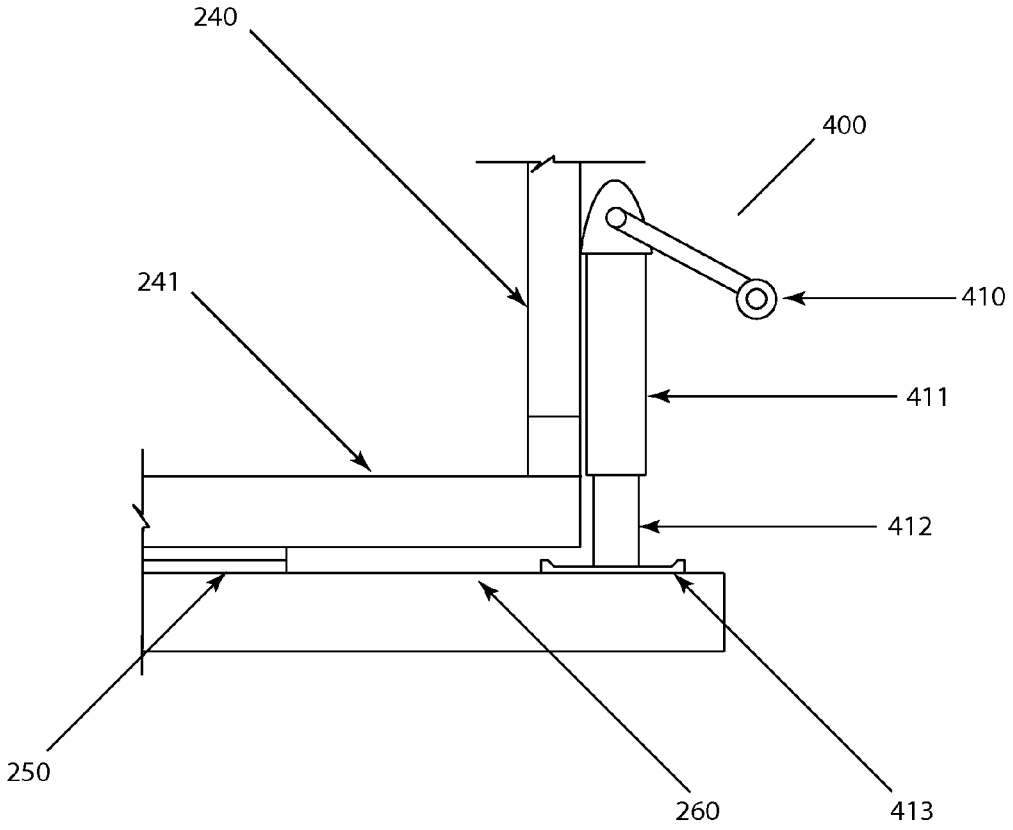
FIG. 7, shows one embodiment of the pivot brake assembly.

Wire rack assembly 200 can be locked into any position by using the pivot brake assembly 400 as shown in FIG. 7. In the embodiment as shown, pivot brake assembly 400 is a geared jack assembly which is securely mounted to an upright 240. However, in other embodiments the pivot brake may be mounted on the cross member 241. The pivot brake assembly 400 having a crank assembly 410, an external casing 411 with an extensible shaft 412 and a friction plate 413. To engage the pivot brake assembly 400, the user would simply turn crank assembly clock-wise 410, extending shaft 412 and engaging friction plate 413 against the base plate 260. The pivot brake assembly is released by turning crank assembly 410 in a counter-clockwise direction. Other embodiments of the pivot brake assembly 400 may include, but is not limited to pneumatic or hydraulic jack assemblies, an electric motorized jack assembly or a cam-over or lever-lock assembly as commonly known in the art.

Figure 6:
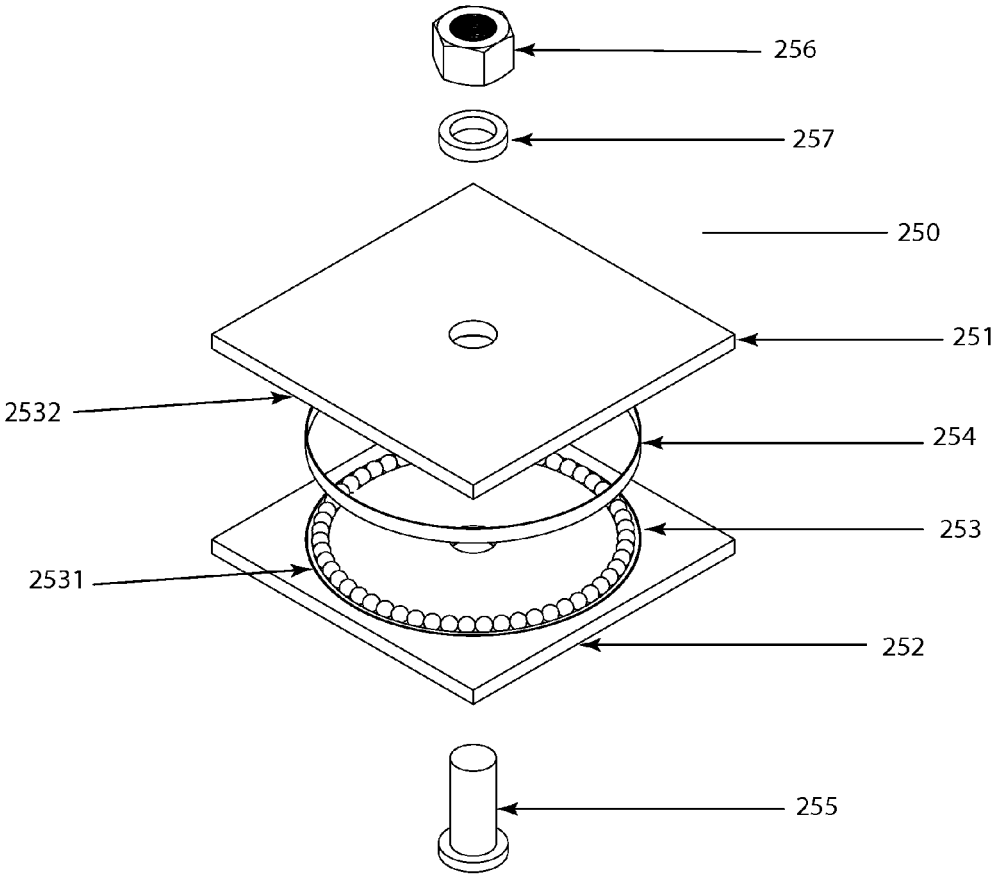
FIG. 6, is an exploded view of the castor plate assembly.

FIG. 6 of the present invention is the castor plate assembly 250 including top plate 251, bottom plate 252, bearings 253, roller ring 254 and a central pin assembly 255 including washer 257 and lock-nut 256. An upper bearing race 2532 (not visible) formed on the inside surface of the top plate 251 and a lower bearing race 2531 formed in the inside surface of the bottom plate 252.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A bulk electrical wire trailer comprising:

a trailer, including, a tongue end, a tail end, two side rails having a c-shaped section, the first end of the c-shaped section positioned toward the tongue end of the trailer and including a stop block, the second end of the c-shaped section is open, the open side of the c-shaped section of each side rail facing toward the center of the trailer, at least one removable wire rack, including, a platform base, a bearing assembly, a wire rack support frame including a lower cross-brace and vertical support posts, the vertical support posts having an attached end and a free end, the wire rack support frame rotatably attached to the platform base using the bearing assembly, a plurality of rotating conductor wire spools assembled on a single axle rotatably coupled to the free end of the vertical support posts, a ground wire spool assembled on the single axle, the ground wire spool rotating independently of the plurality of rotating wire spools, and, wherein the platform base of the at least one removable wire rack includes a plurality of rollers configured to engage the c-shaped section of the side rails, allowing the at least one removable wire rack to be rolled forward and be restrained, within the side rails, vertically and laterally on the trailer.

2. The bulk electrical trailer of claim 1 wherein the lowermost portion of the plurality of rollers is positioned above the bottom surface of the platform base.

3. The bulk electrical trailer of claim 1 including a tail gate configured to close the second end of the c-shaped sections.

4. The bulk electrical trailer of claim 1 wherein the wire rack support frame is rotatable a full 360 degrees on the platform base.

5. The bulk electrical trailer of claim 1 wherein the bearing assembly is a caster plate bearing comprising;

a center pin, an upper plate having a circular upper race, a lower plate having a circular lower race, and, a plurality of spherical bearings which engage the upper race and lower race.

6. The bulk electrical trailer of claim 1 including a rotation lock mechanism attached to the wire rack support frame and configured to engage the top surface of a base plate.

7. The bulk electrical trailer of claim 1 including a friction brake assembly attached to the plurality of rotating conductor wire spools.

8. The bulk electrical trailer of claim 1 including a friction brake assembly attached to the ground wire spool.

9. The bulk electrical trailer of claim 7 wherein the friction brake assembly is one of a disc brake and a drum brake attached to the single axle.

10. The bulk electrical trailer of claim 8 wherein the friction brake assembly is one of a disc brake and a drum brake.

11. The bulk electrical trailer of claim 1 wherein the ground wire spool includes a central hub having bearings independent of the single axle and the ground wire spool is lockable to the plurality of rotating conductor wire spools.

12. The bulk electrical trailer of claim 1 wherein the platform base is configured to be handled by a fork lift.

13. The bulk electrical trailer of claim 1 including a drive coupling formed in a free end of the single axle.

14. The bulk electrical trailer of claim 1 including a spool drive gearbox.

15. The bulk electrical trailer of claim 1 wherein the at least one removable wire rack is two removable wire racks.

16. The bulk electrical trailer of claim 1 wherein the at least one removable wire rack is three or more removable wire racks.

17. A method of distribution of bulk wire comprising:

provide bulk wire at a central distribution warehouse, provide a bulk electrical wire trailer including;

at least one removable wire rack, including, a platform base, a wire rack support frame rotatably attached to the platform base, a plurality of conductor wire spools assembled on a single axle coupled to the wire rack support frame, a ground wire spool assembled on the single axle, the ground wire spool rotating independently of the plurality conductor wire spools, the ground wire spool lockable to the plurality of conductor wire spools, a friction brake assembly for the plurality of conductor wire spools, a friction brake assembly of the ground wire spool, a rotation brake assembly attached to the wire rack support frame, and, a wire spool drive assembly, loading the bulk electrical wire trailer at the central distribution warehouse, by, releasing the friction brake assembly for the plurality of conductor wire spools, releasing the friction brake assembly for the ground wire spool, removing the free ends of conductor wires from bulk wire spools at the central distribution warehouse and starting the free end on each of the plurality of conductor wire spools, removing the free end of a ground wire from a bulk wire spool at the central distribution warehouse and starting the free end on the ground wire spool, locking the ground wire spool to the plurality of conductor wire spools, engaging the wire spool drive assembly, winding a pre-determined length of conductor wires onto the plurality of conductor wire spools, cutting the conductor wires at the pre-determined length, winding a pre-determined length of ground wire onto the ground wire spool, cutting the ground wire at the pre-determined length, engaging the friction brake assembly for the plurality of conductor wire spools to lock the plurality of conductor wire spools into place, engaging the friction brake assembly for the ground wire spool to lock the ground wire spool into place, engaging the rotation brake assembly, transporting the bulk electrical wire trailer to a job site prepared with a plurality of electrical conduits, parking the bulk electrical wire trailer proximate at least one of the plurality of electrical conduits, releasing the rotation brake assembly, aligning the plurality of conductor wire spools and the ground wire spool toward the at least one of the plurality of electrical conduits, adjusting the friction brake assembly for the plurality of conductor wire spools to allow rotation and prevent free-wheeling, adjusting the friction brake assembly for the ground wire spool to allow rotation and prevent free-wheeling, pulling conductor wires and ground wire into the at least one of the plurality of electrical conduits, cutting conductor wires and the ground wire, removing the at least one of the removable wire racks from the bulk electrical trailer, transporting the at least one of the removable wire racks proximate to at least another of one of the plurality of electrical conduits not accessible to the bulk electrical wire trailer, aligning the plurality of conductor wire spools and the ground wire spool toward the at least another of the plurality of electrical conduits, pulling conductor wires and ground wire into the at least another of the plurality of electrical conduits, cutting conductor wires and the ground wire, replacing the at least one of the removable wire racks to the bulk electrical trailer, and, transporting the bulk electrical wire trailer to the central distribution warehouse.

* * * * *